US007841660B2

(12) United States Patent
Wang et al.

(10) Patent No.: US 7,841,660 B2
(45) Date of Patent: Nov. 30, 2010

(54) SWIVEL ROCKER CHAIR AND ASSEMBLY

(75) Inventors: Oliver Wang, Millbrae, CA (US); Huey-Ping Lee, Kowloon (HK)

(73) Assignee: Agio International Company Limited (JP)

( * ) Notice: Subject to any disclaimer, the term of this patent is extended or adjusted under 35 U.S.C. 154(b) by 0 days.

(21) Appl. No.: 12/456,651

(22) Filed: Jun. 19, 2009

(65) Prior Publication Data

US 2010/0207437 A1 Aug. 19, 2010

Related U.S. Application Data

(63) Continuation of application No. 11/227,787, filed on Sep. 15, 2005, now abandoned.

(51) Int. Cl.
*A47C 1/02* (2006.01)

(52) U.S. Cl. ..... 297/260.1

(58) Field of Classification Search ..... 297/258.1, 297/260.1, DIG. 7

See application file for complete search history.

(56) References Cited

U.S. PATENT DOCUMENTS

| | | | | |
|---|---|---|---|---|
| 2,163,078 | A | 6/1939 | Zerbee | |
| 2,313,559 | A * | 3/1943 | Larsen et al. | 297/303.1 |
| 2,360,428 | A * | 10/1944 | Larsen et al. | 248/596 |
| 2,584,184 | A | 2/1952 | Brown | |
| 2,687,166 | A | 8/1954 | Hamilton | |
| 2,828,801 | A | 4/1958 | Papst | |
| 2,973,026 | A | 2/1961 | Haaland | |
| 3,300,244 | A | 1/1967 | Hughes | |
| 3,333,811 | A | 8/1967 | Matthews | |
| 3,547,393 | A | 12/1970 | Gordin | |
| 3,603,553 | A | 9/1971 | Doerner | |
| 3,784,148 | A | 1/1974 | Hill | |
| 3,938,857 | A | 2/1976 | Craig | |
| 3,966,251 | A | 6/1976 | Belisle | |
| 4,067,610 | A | 1/1978 | Doerr et al. | |
| 4,141,530 | A | 2/1979 | Ward | |
| 4,183,494 | A | 1/1980 | Cleveland | |
| 4,191,355 | A | 3/1980 | Faull | |
| 4,236,752 | A | 12/1980 | Mizelle | |
| 4,303,219 | A | 12/1981 | Carrick | |
| 4,371,142 | A | 2/1983 | Bottemiller et al. | |
| 4,372,606 | A | 2/1983 | Faull | |
| 4,786,106 | A | 11/1988 | Bottemiller | |
| 4,893,871 | A | 1/1990 | Kowalski | |
| 4,971,394 | A | 11/1990 | Vanderminden | |
| 5,004,259 | A | 4/1991 | Ayers et al. | |
| 5,022,667 | A | 6/1991 | Gillson | |
| 5,039,164 | A | 8/1991 | Gibbs | |
| 5,171,000 | A | 12/1992 | LaPointe et al. | |

(Continued)

FOREIGN PATENT DOCUMENTS

| | | |
|---|---|---|
| EP | 0056454 A3 | 7/1982 |

(Continued)

*Primary Examiner*—Joseph Edell
(74) *Attorney, Agent, or Firm*—Williams Mullen

(57) ABSTRACT

A swivel rocker chair connection assembly facilitates construction of a swivel rocker chair and allows for the secure and stable operation of the chair. The chair includes a base portion, a seat portion and a connection assembly having at least one dual washer plate adapted to engage one or more rocker spring members positioned and engaged with the chair base and seat portions.

2 Claims, 4 Drawing Sheets

U.S. PATENT DOCUMENTS

| | | | |
|---|---|---|---|
| 5,267,777 | A | 12/1993 | Valtri |
| 5,370,442 | A | 12/1994 | Saul et al. |
| 5,435,622 | A | 7/1995 | Fay et al. |
| 5,564,781 | A | 10/1996 | Pine |
| 5,599,064 | A | 2/1997 | Vanderminden, Sr. |
| 6,547,206 | B1 | 4/2003 | Dickie |
| 6,913,317 | B2 | 7/2005 | Vanderminden et al. |
| 6,918,632 | B2 | 7/2005 | Maki et al. |
| 7,150,087 | B2 | 12/2006 | Maki et al. |
| 2009/0085386 | A1 | 4/2009 | McCoy et al. |

FOREIGN PATENT DOCUMENTS

| | | | |
|---|---|---|---|
| GB | 1379042 | A | 1/1975 |

* cited by examiner

SWIVEL ROCKER CHAIR AND ASSEMBLY

CROSS-REFERENCE TO RELATED APPLICATION

This application is a continuation of the pending U.S. patent application Ser. No. 11/227,787 filed Sep. 15, 2005, entitled "Swivel Rocker Chair and Assembly", which is incorporated herein by reference.

BACKGROUND OF THE INVENTION

Various types of swivel rocker chairs have been known which allow a person seated in the chair to both rotate about a vertical axis and pivot back and forth. While other types of chairs might allow the back of the chair to pivot relative to the seat, swivel rocker chairs are constructed so that the back and seat of the chair pivot and rotate together as a unit. Swivel rocker chairs generally include a base portion and a seat portion, with the seat portion generally including a back portion and potentially armrest portions. Different mechanisms have been employed for securing the base portion of swivel rocker chairs to the seat portion, and these prior art mechanisms have suffered from several deficiencies. First, these prior art mechanisms often fail to provide a secure connection, which can result in the seat falling off of the base and potential injuries to the chair occupant and bystanders. Further, because many chairs are packaged so that they may be assembled on site by the end user, the parts and/or assembly instructions are often not sufficient to ensure that the chair is assembled properly so as to maintain full functionality and stability.

SUMMARY OF THE INVENTION

Disclosed is a swivel rocker chair comprising a base assembly, a seat assembly and at least one rocker spring member. The base assembly includes a T-bar member comprised of a stem portion and a top cross portion that are in adjacent horizontal planes and are also perpendicular to one another. The seat assembly includes a lower stabilizing element having an upper surface. The at least one rocker spring member includes a first end and a second end. The first end cooperatively engages the T-bar member and the second end cooperatively engages the seat assembly lower stabilizing element.

In addition, a connector assembly connects the base assembly to the seat assembly. The connector assembly comprises a washer plate member having first and second inner surfaces that form substantially parallel side walls and a bridge portion connecting said side walls. The first inner surface cooperatively engages the upper surface of the lower stabilizing element of the seat assembly. The second inner surface cooperatively engages a lower surface of the second end of the at least one rocker spring member. The swivel rocker chair further includes means for connecting together the at least one rocker spring member, the at least one washer plate member, and the lower stabilizing element.

The at least one rocker spring member can further include a pair of rocker spring members, each mounted to the T-bar member at the first end, and each secured to the seat assembly lower stabilizing element at the second end by a pair of the connector assemblies.

DETAILED DESCRIPTION OF THE PREFERRED EMBODIMENTS

Figure 1:
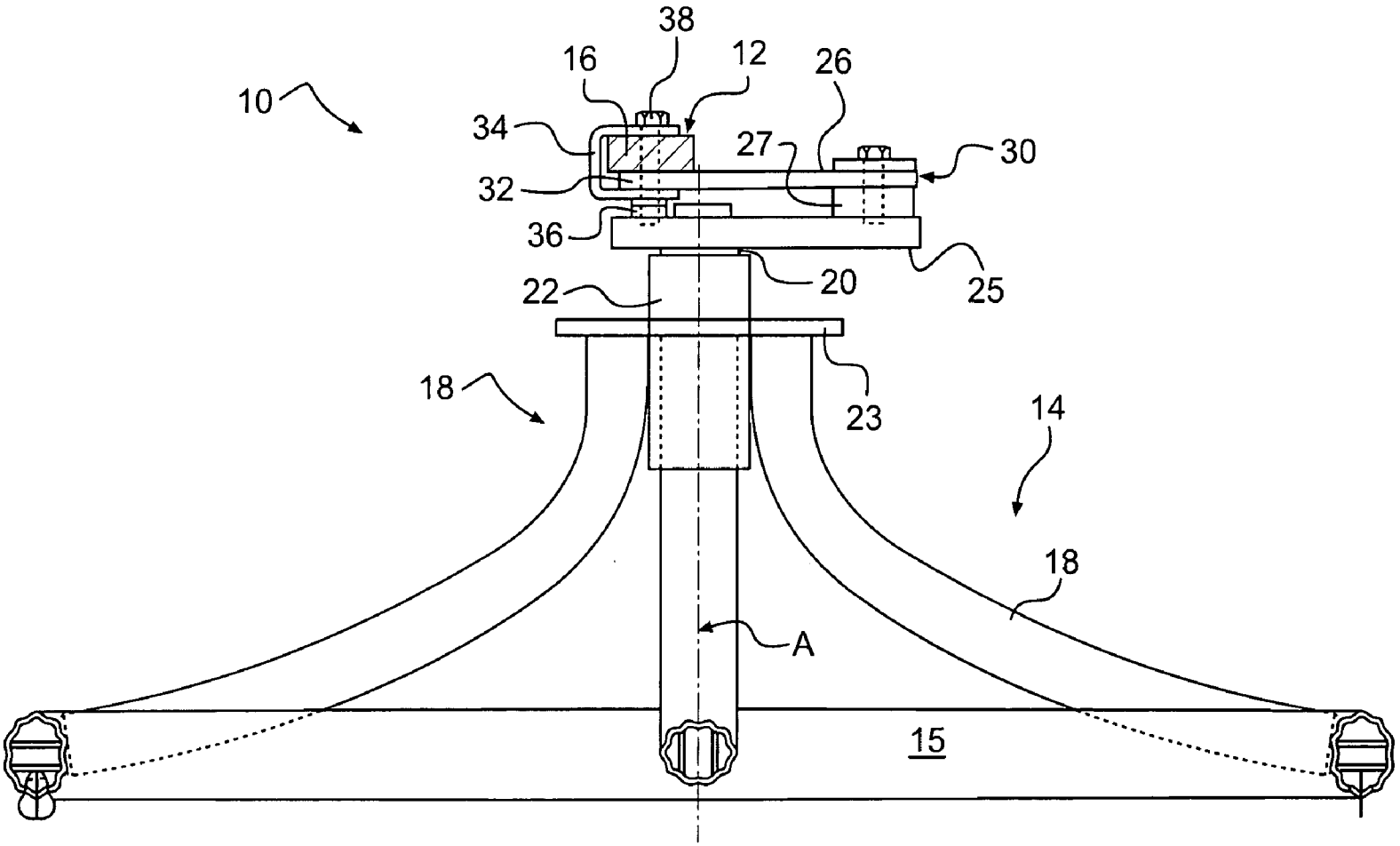
FIG. 1 shows a front elevation of the swivel rocker assembly of the present invention affixed atop a base member for a swivel rocker chair.
Figure 2:
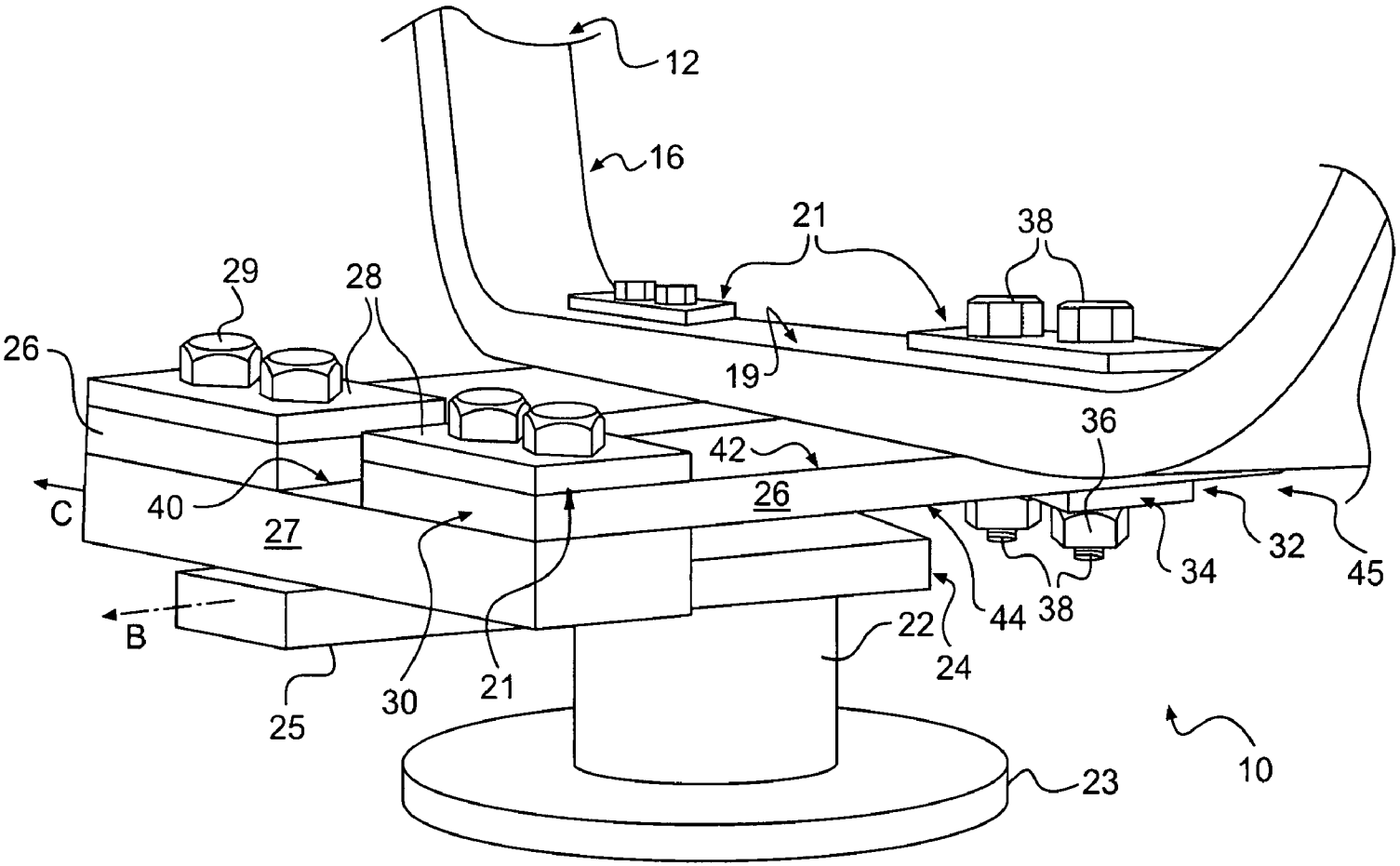
FIG. 2 shows a perspective view of one embodiment of the swivel rocker assembly and portions of the chair of the present invention.

FIGS. 1 through 4B show a swivel rocker chair connector assembly in accordance with the present invention. As shown in FIGS. 1 and 2, the swivel rocker chair connector assembly 10 connects a chair seat portion 12 to a chair base 14. The chair seat portion 12 can be, for example, a lower stabilizing member such as U-bar member 16 which extends downwardly from the horizontal seat surface (not shown). The chair base assembly 14 can be provided with a base portion 15 that rests on the ground surface, legs 18 and a shaft 20 maintained in a cylindrical sleeve 22 so as to allow for rotation about a chair base axis, indicated at A. Legs 18 and cylindrical sleeve 22 can be secured to platform 23 by commonly known means, for example.

Figure 3:
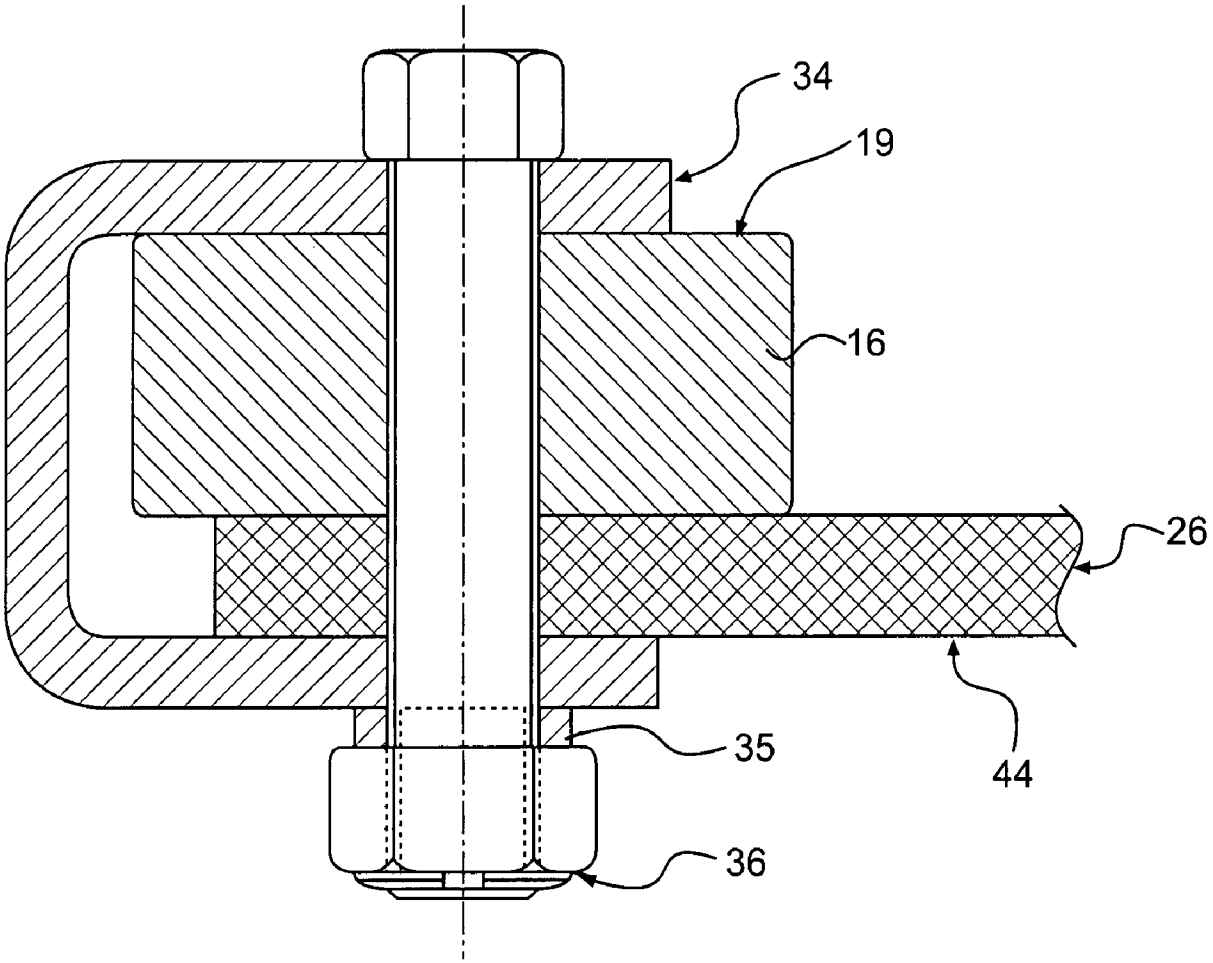
FIG. 3 shows a front cutaway elevational view of the swivel rocker connection assembly of the present invention in partial cross-section.

A T-bar member 24 and a pair of substantially flat rocker spring members 26 can be provided as part of chair base assembly 14. Connector assemblies 21 such as washer plates 28, bolts 29 and nuts can be provided for securing the rocker spring members at a first end 30 to the T-bar member 24. Connector assemblies 21 are also provided to secure the other end 32 of the rocker spring members 26 to the chair seat portion 12. As shown in FIGS. 2 and 3, the connector assembly of the present invention can comprise dual washer member(s) 34 and one or more nut 36 and bolt 38 combinations. The connector assembly may also optionally include the T-bar member 24 and rocker spring members 26.

In one embodiment, the connection of the rocker spring members 26 to the chair seat portion 12 can be accomplished by connecting means such as clamps, glue, or spot welds, for example, as opposed to washer members 34, nuts 36 and bolts 38.

The T-bar member 24 is generally comprised of a stem portion 25 and a top cross portion 27. The stem portion 25 of the T-bar member 24 is secured to the chair base shaft, which is rotatably maintained within the chair base by any of various means known in the art. As shown in FIG. 2, the stem portion 25 is secured in a first substantially horizontal plane B when secured to the chair base 14. The top cross portion 27 is secured to the stem portion 25 and extends in a second substantially horizontal plane C that is adjacent to the horizontal plane B of the stem portion 25, as shown in FIG. 2. The top cross portion 27 and stem portion 25 are secured such that they are substantially perpendicular to one another. As further shown in FIGS. 1 and 2, T-bar member 24 has an upper surface 40 which can cooperatively engage lower surfaces of respective rocker spring members 26. It will be appreciated that T-bar member can be part of a chair base assembly or part of the connector assembly of the present invention.

As shown in FIGS. 1 through 3, each rocker spring member 26 is provided with a first end 30, a second end 32, a top face 42, and a bottom face 44. The rocker spring members 26 are secured on opposite sides of the chair base axis A and lie in substantially the same horizontal plane when at rest. This arrangement assists in the overall stability of the chair. The rocker spring members 26 can be substantially flat as shown in FIGS. 1 and 2. The rocker spring members 26 further have holes at each end 30 and 32 that cooperate with appropriate washer plate bolts and washer plates. The first end 30 of the rocker spring member 26 is positioned above the T-bar member top cross portion 27 such that the bottom face of the rocker spring member cooperatively engages the T-bar member top cross portion upper face 40, with the second end 32 being positioned such that the rocker spring member 26 top face rests underneath and cooperatively engages the bottom surface 45 of the chair seat portion 12.

It will be appreciated that, in an alternative embodiment, the present invention can operate with a single rocker spring member 26 secured in substantially the middle of the T-bar member 24 and in a plane above the chair base shaft, wherein such plane is substantially perpendicular to the chair base axis in the resting position.

Rocker spring members 26 can be secured to T-bar member 24 by bolts, nuts and washer plates in accordance with one embodiment of the present invention. In one embodiment, rocker spring members 26 are secured to T-bar member 24 prior to shipment of the swivel chair parts to be assembled by the end user. In one embodiment of the invention, rocker spring members 26 can be formed of a fiberglass reinforced plastic.

Figure 4B:
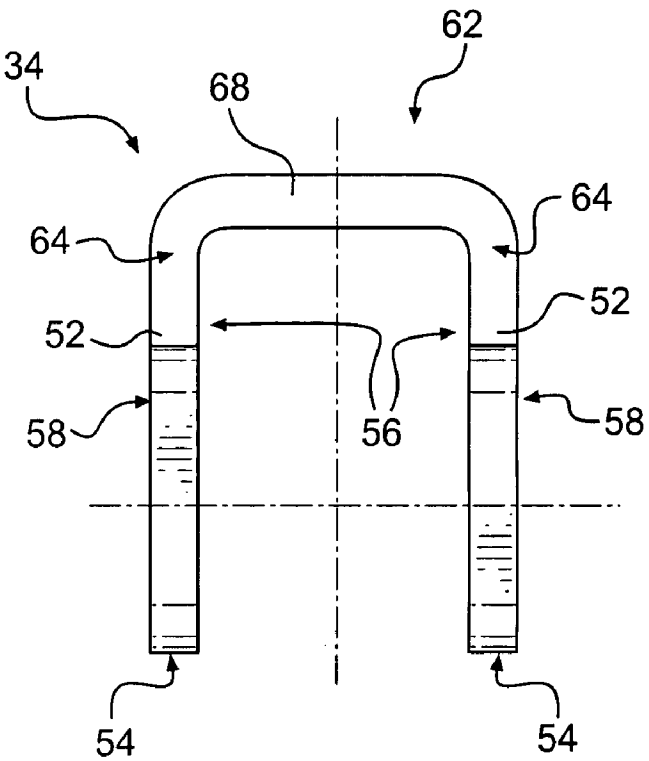
FIGS. 4A and 4B show a front elevation and right side view, respectively, of a washer plate member of the swivel rocker assembly of the present invention.
Figure 4A:
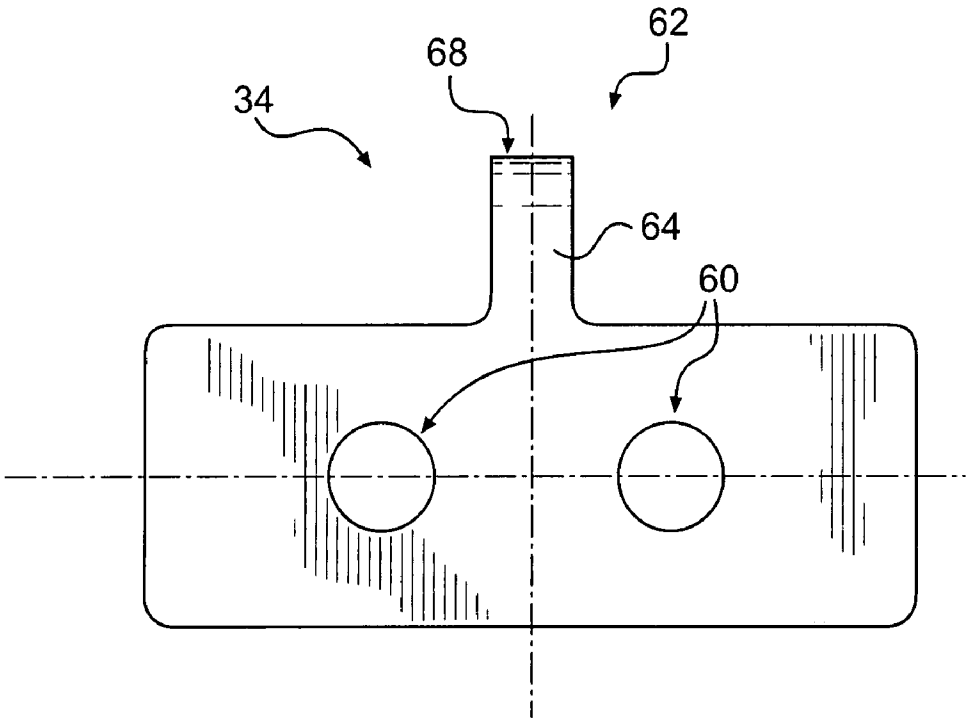

As shown in FIGS. 3, 4A and 4 B, at least one washer plate member 34 is provided having a pair of side walls 52 extending in substantially parallel relation, wherein each of the side walls 52 has an outer edge 54, an inner 56 and an outer 58 surface and at least two openings 60 therein. The space between the two opposing and parallel side walls is provided so as to cooperate with the combined thickness of the U-bar and rocker spring, as shown in FIG. 3. The washer plate member 34 further includes a bridge portion 62 integrally formed with and connecting the side walls 52, wherein the bridge portion 62 has leg members 64 which extend laterally from the wall outer edges 54 and a joint portion 68 extending substantially perpendicularly from and connecting the leg members 64.

The washer plate members 34, which can be substantially U-shaped in cross section, for example, help secure the second ends 32 of respective rocker spring members 26 to U-bar member 16 or other seat portion stabilizing member. This dual washer plate 34, as shown in FIG. 3, engages on one end the interior surface 19 of the substantially flat portion of U-bar member 16. As further shown in FIG. 3, the washer plate members 34 engage, on the other end, the bottom surface 44 of the rocker spring members 26 such that a washer plate bolt 38 passes sequentially through the first wall of the washer plate member 34, the U-bar member 16 of the seat assembly, the rocker spring member 26, the second wall of the washer plate member 34, a lock washer 35 (optional), and a nut 36. It will be appreciated that U-bar member 16 and/or other seat assembly member is provided with openings that mate with the openings in washer plate member 34 to allow bolt 38 to pass through.

In one embodiment of the invention, the washer plate bolt 38 can be provided such that only the end portion of the bolt is threaded. In one embodiment, the threaded portion of the bolt represents approximately 25% of the entire length of the shaft of the bolt.

The present invention further provides means for securing the rocker spring members 26 to the washer plate members 34 such that the inner surface of one of the washer plate member walls 52 cooperatively engages the seat chair portion 12 in mating relationship therewith, and further such that the inner surface of the second washer plate member walls cooperatively engages and is in mating relationship with the rocker spring member 26 bottom face near the second end of the rocker spring member 26. The connection or securing means can include a pair of bolts 38 extending through the openings of the washer plate member walls 52.

In one embodiment of the invention, each of the bolts includes a shaft which is partially threaded. In one embodiment of the invention, the chair seat portion 12 lies in a plane which is between the bridge portion of the washer plate member 34 and the T-bar member top cross portion 27.

The present invention makes it nearly impossible to omit or to mis-position the washer plate members 34 during installation. The partial threading of the washer plate bolt 38 makes it impossible to attach the u-bar member 16 directly to the rocker spring member 26 without the dual washer plate.

Other embodiments may be employed to achieve this result. One such alternative embodiment includes pre-assembling the U-bar member 16, washer plate members 34, rocker spring member 26, T-bar member 24 and swivel shaft, thereby eliminating the need for user assembly. Another embodiment is to bond the washer plate members 34 to the U-bar member 16 by welding or glue, for example. Another embodiment involves bonding the washer plate member 34 to the rocker spring member 26. Yet another embodiment involves bonding all washer plate members 34 into proper position. The embodiment shown in the drawings is preferred and optimizes cost of production, ease of assembly and bulk shipping.

A method of installing a swivel rocker chair can be accomplished as follows. First, a base assembly can be provided with a connected T-bar member substantially as described above. Then, a seat assembly having a lower stabilizing member can be provided. Next, one or more rocker spring members can be provided, wherein the rocker spring members have a first end and a second end, with the first end cooperatively engaging the T-bar member and the second end cooperatively engaging the seat assembly lower stabilizing element. Next, a dual washer plate member can be provided, wherein the plate has a pair of walls each having an interior surface, such that a first interior surface cooperatively engages an upper surface of the seat assembly lower stabilizing member, and such that a second interior surface cooperatively engages a lower surface of each of the one or more rocker spring members. Next, a bolt member can be passed sequentially through the washer plate, lower stabilizing member, rocker spring member, and again through the washer plate, and the bolt member can be secured in the passed-through position by a nut or other similar object.

The invention may be embodied in other specific forms without departing from the spirit or essential characteristics thereof. The present embodiments are therefore to be considered in all respects as illustrative and not restrictive, the scope of the invention being indicated by the claims of the application rather than by the foregoing description, and all changes which come within the meaning and range of equivalency of the claims are therefore intended to be embraced therein.

What is claimed is:

1. A swivel rocker chair, comprising:

a base assembly comprising a vertically configured sleeve secured to a platform above a chair base housing a vertical shaft rotatable around a chair base axis within the sleeve, said shaft secured to a T-bar member comprised of a stem portion and a top cross portion above said stem portion in adjacent horizontal planes wherein said stem portion and said top cross portion are substantially perpendicular to one another;

a seat assembly having a lower stabilizing element, said lower stabilizing element having an upper surface;

at least one rocker spring member having a first end and a second end, said first end cooperatively engaging said top cross portion and said second end cooperatively engaging said seat assembly lower stabilizing element;

a connector assembly connecting said first end and said top cross portion and said base rocker spring member(s) to said base;

a washer plate member having first and second inner surfaces, said first inner surface capable of cooperatively engaging said upper surface of said lower stabilizing element of said seat assembly, and said second inner surface capable of cooperatively engaging a lower surface of said second end of said rocker spring member(s);

at least one connector assembly connecting said top cross portion and said first end of said at least one rocker spring member;

at least one washer plate member having first and second inner surfaces, said first inner surface capable of cooperatively engaging said upper surface of said lower stabilizing element of said seat assembly, and said second inner surface capable of cooperatively engaging a lower surface of said second end of said at least one rocker spring member;

and means for connecting together said at least one rocker spring member, said at least one washer plate member, and said lower stabilizing element.

2. The swivel rocker chair of claim 1 wherein said at least one washer plate member includes substantially parallel side walls and a bridge portion connecting said side walls.

* * * * *